US007358910B2

(12) United States Patent
Blickle

(10) Patent No.: US 7,358,910 B2
(45) Date of Patent: Apr. 15, 2008

(54) VEHICLE ROOF ANTENNA WITH A MOUNTING PART FOR AN ANTENNA ROD WITH SIMULTANEOUS SECURING OF A COVER HOOD

(75) Inventor: Günther Blickle, Walddorfhaslach (DE)

(73) Assignee: Hirschmann Car Communication GmbH, Neckartenzlingen (DE)

( * ) Notice: Subject to any disclaimer, the term of this patent is extended or adjusted under 35 U.S.C. 154(b) by 0 days.

(21) Appl. No.: 11/509,830

(22) Filed: Aug. 24, 2006

(65) Prior Publication Data

US 2007/0075904 A1 Apr. 5, 2007

(30) Foreign Application Priority Data

Aug. 30, 2005 (DE) ..... 10 2005 040 942

(51) Int. Cl.
*H01Q 1/32* (2006.01)

(52) U.S. Cl. ..... 343/713; 343/715

(58) Field of Classification Search ..... 343/711, 343/713, 715

See application file for complete search history.

(56) References Cited

U.S. PATENT DOCUMENTS 5,838,281 A * 11/1998 Blaese ..... 343/715
6,331,838 B1 * 12/2001 Scott et al. ..... 343/715
6,509,878 B1 1/2003 Tornatta ..... 343/715
6,535,171 B1 * 3/2003 Lauermann et al. ..... 343/715
7,019,701 B2 * 3/2006 Ohno et al. ..... 343/715
7,212,168 B2 * 5/2007 Kozlovski ..... 343/713
2003/0193440 A1 * 10/2003 Yang ..... 343/711
2003/0231140 A1 * 12/2003 Haussler et al. ..... 343/888
2006/0103579 A1 * 5/2006 Blickle ..... 343/711
2007/0040757 A1 * 2/2007 Blickle ..... 343/713
2007/0046551 A1 3/2007 Takeno ..... 373/713

FOREIGN PATENT DOCUMENTS

DE 202004004740 9/2004
JP 10093327 4/1998
JP 2002076732 3/2002

* cited by examiner

*Primary Examiner*—Tan Ho
(74) *Attorney, Agent, or Firm*—Andrew Wilford

(57) ABSTRACT

An antenna for mounting on a vehicle roof has a base plate adapted to sit on the roof and a threaded fastener separate from the base plate, extending through the base plate and anchored underneath the base plate in the roof. A cover fitted over the base plate is formed with a throughgoing passage generally aligned with the fastener. The fastener is operable by a tool extending through the passage. An antenna rod screwable into the passage is fixed thereby to the cover. The cover can comprise an inner cover fitted over the base plate and formed with an outwardly open threaded socket and a decorative outer cover fitted over the inner cover around the socket. In this case the antenna rod has an end screwable into the socket and bearing downward on the outer cover to secure the outer cover on the inner cover and base plate.

10 Claims, 4 Drawing Sheets

VEHICLE ROOF ANTENNA WITH A MOUNTING PART FOR AN ANTENNA ROD WITH SIMULTANEOUS SECURING OF A COVER HOOD

FIELD OF THE INVENTION

The invention relates particularly to roof antennas for motor vehicles with screw-on antenna rods, which antenna can be mounted on a vehicle roof by means of at least one mounting element, a cover being provided to which an antenna rod can be attached.

BACKGROUND OF THE INVENTION

On roof antennas for vehicles, the antenna rods are designed with externally thread bases and matching mounting parts designed as threaded bushings are located inside the cover, into which elements the antenna rods are screwed. The following descriptions are limited to this most common embodiment, while an embodiment exists in which the inside of the antenna rod comprises an internal thread and the cover has a matching counterpart with a threaded pin, to which the invention is also applicable. Accordingly, the invention is applicable to any other conceivable connection of the antenna rod to the cover, such as a plug connection of the antenna rod to the cover etc.

The bushing, which is typically made of metal, on the one hand serves the function of fixing the antenna rod mechanically to the cover and of absorbing forces applied to the antenna rod during vehicle operation, and on the other hand serves to transmit the electrical signal from the antenna rod through the cover into the inside of the roof antenna, where it is typically picked up by a contact spring mounted on a printed circuit board for further electronic processing. So as to fix the bushing in a stable and waterproof way in the cover, the threaded hole is designed as a tapped blind hole and the bushing is typically incorporated as an insert during manufacturing of the cover in a plastic injection molding process.

OBJECT OF THE INVENTION

The invention is based on the object of designing the mounting part for the antenna rod in such a way that in addition to the functions described above it may assume further suitable tasks. In particular, it should be possible to open and close off access to the inside of the roof antenna by means of the mounting part, through which access, for example, a mounting element of the roof antenna can be accessed and operated. Alternatively or additionally, the mounting part should provide the opportunity of mounting an outer cover surrounding the inner or main cover.

SUMMARY OF THE INVENTION

This task is solved according to the invention, in a first alternative that a socket having a passage is arranged in the cover, in which part one end of the antenna rod may be inserted after a tool engaging the mounting element has been inserted through the passage for mounting the roof antenna on the vehicle roof. As a result, the socket assumes in two functions: on the one hand, passage of the tool allows fastening of the roof antenna on the vehicle roof from the outside of the vehicle. Such access, which otherwise could also be implemented in a different location of the cover, has the advantages that it is later covered by the mounted antenna rod and therefore invisible, preventing any impairment to the aesthetic appearance of the cover, and that the access is protected from splashing water and pollution. After the roof antenna has been mounted, the socket is covered by the rod end, or where applicable by an additional separate piece in order to cover the inside of the roof antenna. This is particularly required if additional elements (such as antenna radiators, electronics, GPS modules or the like) are provided beneath the cover on the inside of the roof antenna.

In a second alternative of the invention, it is provided that a socket is disposed inside the cover, in which part a rod end of an antenna rod can be inserted, wherein the roof antenna has the outer cover surrounding the inner cover and the socket is designed for fixing the outer cover. The outer cover serves the purpose of implementing different geometric configurations, colors or the like with an otherwise identical set-up of the roof antenna in terms of the interior equipment and cover, without requiring modifications to the cover. In addition, the presence of the outer cover improves the stability and the effects of outer influences such as mechanical stress (for example inside a car wash) or rain, ice, airflow or the like. In this case, the socket is designed for fixing the outer cover to the cover and for receiving the antenna rod. With respect to such a design, reference is also made to the subsequent description of the figures.

In this alternative, a retaining function for the design outer cover may be integrated into the socket (with or without mounting element), which design outer cover may be painted in the color of the car, for example. Such a design satisfies the requirements of vehicle manufactures for a roof antenna with a high-quality visual design, even as an option. This means that an outer cover with a painted, structured, marbled or otherwise visually enhanced design may be mounted—even subsequently—on a regular roof antenna with a black standard cover. This results in the additional advantage that the design outer covers may be flexibly combined with the electronic variations of the roof antenna so that the number of variants is not a function of the multiplication of the number of electronics variations with e.g. body color variances, but instead the number of variants may be kept small.

Furthermore it is conceivable to design the socket such that the two alternative solutions may now be implemented in a way that they complement each other. Thus, the socket may comprise the passage for the assembly tool and at the same time it may be designed for fixing the outer cover to the cover.

Such a design is not mentioned in the figure description and is not illustrated in the figures, however it is evident from the combination of the socket according to FIG. 1 with the fixation of the outer cover according to FIG. 3.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
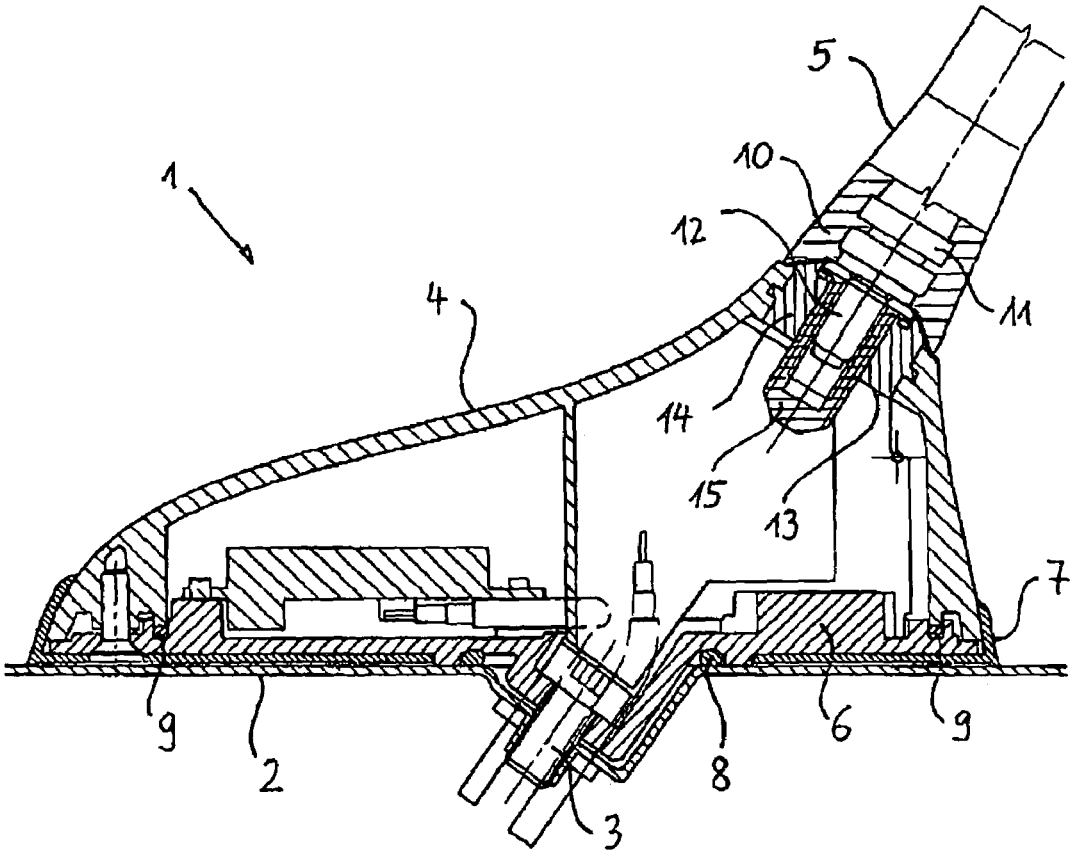
FIGS. 1 and 2 are side and perspective sectional views of a first embodiment of the invention.
Figure 2:
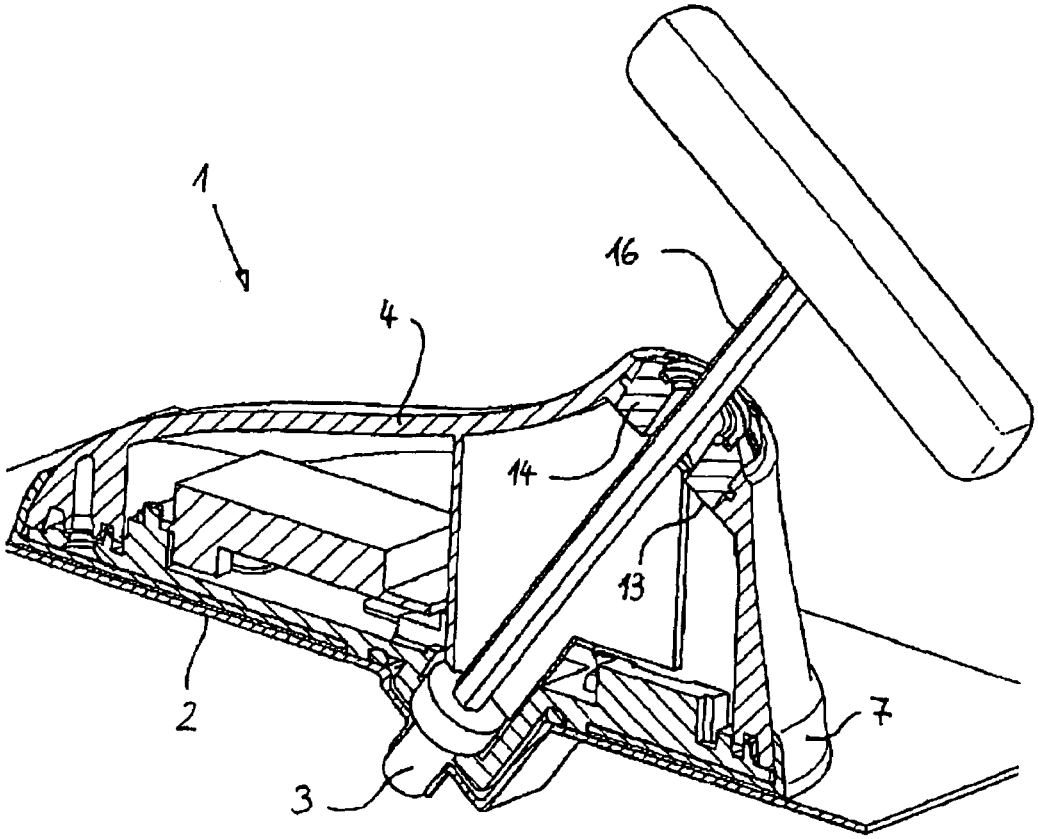

In FIGS. 1 and 2, a roof antenna 1 is mounted on a vehicle roof 2 (or optionally also in an alternate location on a surface of the vehicle), namely by means of a mounting element 3 (here a screw). The roof antenna 1 comprises a cover 4 on whose upper side an antenna rod 5 (with antenna radiator, which is not illustrated in detail) can be mounted. On the inside of the roof antenna 1 below the cover, additional elements such as a base plate 6, seals 7-9, additional antenna radiators, a GPS module, electronics elements (for example an antenna amplifier), plug connectors and the like are provided. This list is exemplary, meaning the elements mentioned may exist in an appropriate combination, however they do not have to. The antenna rod 5 has a rod end 10 with on one end a metal base body 11 that interacts with the antenna radiator that is not illustrated. A threaded pin 12 projects from the rod end 10 and can be screwed into a socket 13 according to the invention, the socket 13, for example, being molded into the material of the cover 4 and fixed thereby. If the socket 13 is a single piece, it has a thread for the threaded pin 12 as well as a passage for access to the mounting element 3 from outside the cover 4. In the embodiment according to FIGS. 1 and 2, the socket 13 consists of two parts, namely a mounting part 14 (positively and/or non-positively fixed in the cover 4) having a passage that is not described in detail. Following mounting of the roof antenna 1, a threaded bushing 15 may be inserted into this passage, which on the one hand closes the passage in the mounting part 14 and on the other hand allows the threaded pin 12 of the rod end 10 to be received. Mounting of the antenna 2 is illustrated in FIG. 2, where a tool 16 is shown inserted through the passage of the mounting part 14. In this arrangement it is essential that the longitudinal axes of the socket 13 and the orientation of the mounting element 3 as well as the longitudinal axis of the tool 16 inserted therein be aligned with each other.

Figure 3:
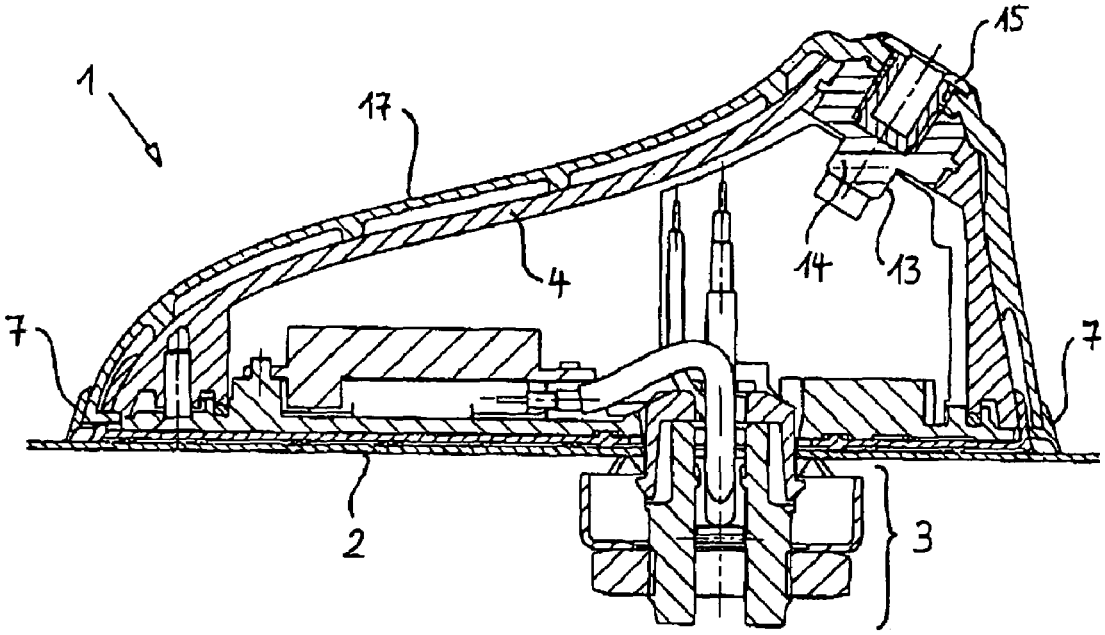
FIGS. 3 and 4 are side and detail views of a second embodiment of the invention.
Figure 4:
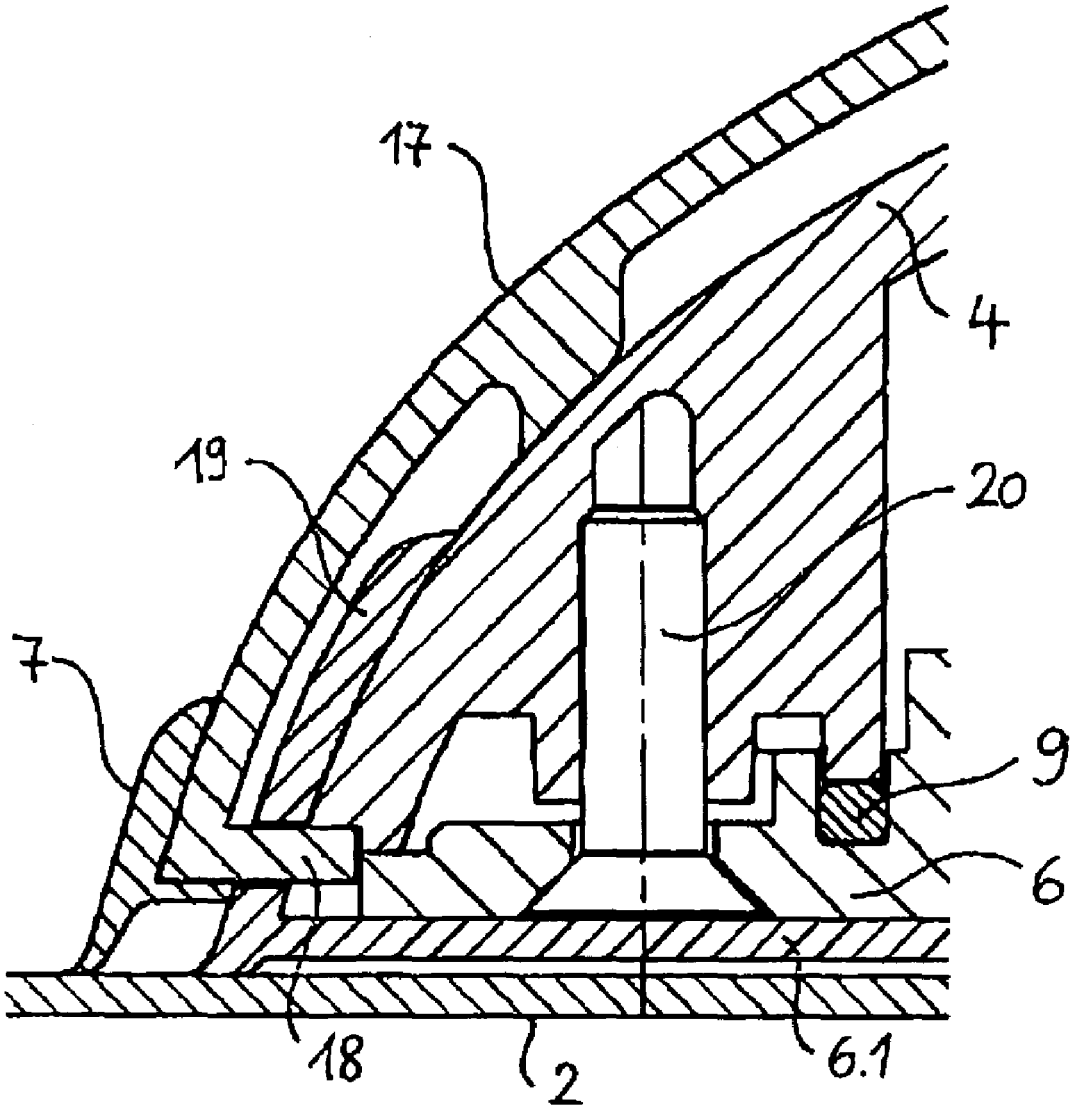

Another embodiment of the invention is illustrated in FIGS. 3 and 4, showing that an outer cover 17 is arranged above the cover 4. In this case, the socket 13 (configured as a single piece or consisting of the mounting element 14 and the bushing 15) is configured such that it can receive the rod end 10 and that it fixes the outer cover 17 to the cover 14. In this case, the socket 13 may either be configured such that it has a passage for the tool 16 or that this passage is eliminated if, as is illustrated for example in FIG. 3, the mounting element 3 cannot be operated from the outside of the roof antenna 1, but rather from below. While fixing of the outer cover 17 to the cover alone may only be achieved with the socket 13, it is useful to provide additional fixation points. According to the embodiment in FIG. 3, it is provided that the outer cover 17 comprises snap-on parts for fixing it to the cover 4. These snap-on parts, which are illustrated in FIG. 4, are designed as catch tabs 18 on the outer covers 17, which parts engage in recesses in the covers 4, particularly in recesses in lugs 19 of the cover 4. This allows for a particularly simple mounting of the outer cover 17 to the inner cover 14, as will be described in the following.

After the roof antenna 1 with the elements thereof, including the inner cover 14, has been mounted to the vehicle roof 2 and fixed by means of the mounting element 3, the outer cover 17 is inserted with the catch 18 into the recess of the lug 19 and tilted in such a way that the outer cover 17 with its lower peripheral edge rests across the entire surface either on the vehicle roof or on the seal 7. Afterward, the single- or multi-part socket 13 may be inserted, particularly screwed on, so that the outer cover 17 is fixed permanently, yet removably, to the cover 4. Depending on the design, it may also be conceivable to nondetachably connect the socket 13 to the cover 4 as well as to the outer cover 17, for example by means of gluing. Additionally it may be conceivable to use the socket 13 as it is illustrated in FIGS. 1 and 2 in the embodiment according to FIGS. 3 and 4, as a result of which it will take on a dual function, meaning securing the outer cover 17 to the cover 4 while simultaneously offering the possibility of inserting and removing the tool 16 for operation of the mounting element 3 through the passage.

A particularly preferred embodiment of the socket 13 can be that the mounting part 14 is made of plastic (particularly made from the same material as the cover 4 and/or the outer cover 17) and that the threaded bushing 15 to be inserted here is made of an electrically conductive material. The mounting part 14 made of plastic has the advantage that, particularly if the cover 4 and/or the outer cover 17 are made of plastic and are manufactured in an injection-molding process, it establishes a particularly good and durable connection, particularly with the cover 4, when it is inserted into the mold for the cover 4 and plastic is molded around it. The threaded bushing 15 made of metal has the advantage that it allows transmission of the high-frequency signals received or sent by the antenna radiator in the antenna rod 5 in that the threaded bushing 15 is connected to the corresponding transmission media such as a cable or directly to a printed circuit board. In addition, it should be noted that the rod end 10 may also be designed as a threaded bushing, while the bushing 15 is not designed as such but rather as a projecting threaded pin.

In summary, the invention offers two solutions of the given task, each solution being applicable individually, however both solutions may also be applied together as is illustrated once more in the following.

1. Access to a Mounting Element Located in the Interior of the Antenna:

The roof antenna is provided with a mounting element located on the inside, preferably a screw which is directly screwed into the vehicle roof, where if applicable the vehicle roof may be formed accordingly in the screw connection area for example by means of a deep drawing process and the screw itself cuts the thread into the sheet metal when it is screwed in. Alternatively, fastening on the roof side may be implemented by means of a clamping plate located underneath the vehicle roof or, for example, by means of a clip-on or rivet nut. The threaded bushing with the tapped blind hole for the antenna rod in the cover is designed as a removable part. Therefore it advantageously comprises an external thread that interacts with the internal thread in the cover as well as, for example, with a slot on its outer collar for engaging the screwdriver. In the simplest embodiment, the internal thread in the cover may be molded directly in the plastic or in a higher-quality embodiment (as has been described above) it can be formed by an additional piece made of metal, for example, having the internal thread, and positively injection molded as an insert in the plastic cover. A seal is provided between the removable threaded part and the cover and/or the possibly provided insert of the cover, which seal in the assembled state of the threaded part in the cover seals the cover against penetrating humidity and/or dirt. A separate O-ring is shown, but a seal lip that is molded to the housing, or a seal edge on the inside of the collar of the threaded part may also be provided. If the threaded part is removed from the cover, access to the mounting element in the roof antenna is provided for inserting the tool so that through this access the roof antenna may be mounted to the car body or may also be removed from it again. After completing mounting of the roof antenna on the car body, the threaded bushing is screwed into the opening of the cover from the outside, tightly sealing the cover and establishing a connection with the contact spring on the printed circuit board (not illustrated). So as to prevent the tool from damaging the electronics components on the inside of the roof antenna, a wall, channel or the like is provided inside the cover, shielding the electronics from contact or damage by the tool. At the same time, when inserted, the tool is guided toward the mounting element by this element, significantly simplifying mounting. Thereafter the antenna rod may be screwed into the mounted threaded part in the usual fashion, completely covering the threaded part and making it not only invisible from the outside, but also protecting it from splashing water or pollutants. The tightening and/or loosening torque of the threaded part in the cover is selected such that during loosening of the antenna rod the threaded part remains tightly inside the cover, meaning that the tightening and loosening torque of the threaded part is selected to be considerably higher than that of the antenna rod. This is easy to accomplish as the antenna rod is only manually tightened with little torque. If the axes of the mounting element and of the removable threaded part however do not extend parallel to each other (as is illustrated in the layout above), but instead are more or less inclined towards each other in the vertical driving direction plane, the use of special tools may be required. With a low inclination, a hex driver with a ball-shaped head may be used, for example in conjunction with a cylinder screw with hex socket; for larger angles hinged tools may be used. The use of special tools has the advantage that unauthorized removal of the roof antenna is complicated.

2. Mounting of a Design Outer Cover on the Roof Antenna

Where applicable, the removable threaded bushing may be used for fixing a decorative outer cover, which may either be painted, stained, marbled or structured in the vehicle color in a visually advantageous way, on the roof antenna. For this purpose, a suitable area is integrally formed on the outer cover that, following placement of the outer cover on the roof antenna during fastening of the threaded part, is clamped between the collar and a contact surface on the cover and/or its insert part.

Advantageously, sealing is done here in the way described above between the threaded part and the outer cover. The outer cover and/or the inner cover may comprise areas that in contact with the respective other part in certain points or across a surface and thus ensure the correct positioning of the outer cover on the inner cover. The outer cover may have a seal in the form of a peripheral sealing lip, which when mounted to the inner cover seals the outer cover relative to the vehicle roof and/or creates a visually attractive transition. The seal may be designed as a separate part or may be integrally formed on the outer cover. The seal on the outer cover may also comprise a contact area with the inner cover and thus seals the gap between the two covers. In the simplest case, additional sealing of the outer cover is dispensed with, whereby advantageously the outer cover with its inner lower edge rest against the existing peripheral seal of the roof antenna, thus sealing the gap between the two covers. In addition to the screw connection to the threaded part, the outer cover may comprise one or more regions that positively engage the inner cover or the base plate of the roof antenna, thereby increasing the stability of the outer cover fastening on the roof antenna. The one catch on the front/inside of the outer cover makes it possible that during mounting of the outer cover it first positively engages through a recess of the peripheral sealing lip beneath a lug of the cover before the screw connection is established in the rear area of the roof antenna in the way described above by means of the removable threaded bushing, thus fixing the front catch as well. The removable threaded bushing and the seat thereof in the cover may advantageously be designed such that the same bushing fits in or on the outer cover and that also the sealing as well as the connection to the contact spring function correctly in both cases. In particular it is also feasible and advantageous to configure the design such that the described tool access as well as the possibility for fastening the outer cover on the roof antenna are implemented in the same embodiment. If only the mounting of the outer cover on the roof antenna is implemented and an additional insert part, preferably made of metallic material, is used in the cover, then this part may be designed such that it allows electrical contact in the downward direction to the spring on the circuit board and that the seat for the removable threaded part is designed as a tapped blind hole. This has the advantage that even with a removable threaded part, the roof antenna does not have an opening and therefore remains waterproof and dirt-proof.

The invention claimed is:

1. An antenna adapted to be mounted on a vehicle roof, the antenna comprising:

a base plate adapted to sit on the roof;

a threaded fastener separate from the base plate, extending through the base plate and anchored underneath the base plate in the roof;

a cover fitted over the base plate and formed with a throughgoing passage generally aligned with the fastener, the fastener being operable by a tool extending through the passage; and an antenna rod screwable into the passage and fixable thereby to the cover.

2. The vehicle defined in claim 1 wherein the antenna rod has a threaded lower end and the passage is provided with a screwthread with which the lower end is engaged.

3. The vehicle defined in claim 2, further comprising a cup-shaped internally and externally threaded socket threaded into and closing the passage and internally receiving the lower end of the rod.

4. The vehicle defined in claim 3 wherein the cover is made of plastic and the socket of metal.

5. The vehicle defined in claim 2 wherein the passage is centered on an axis and the fastener extends along and is rotatable about the axis.

6. The vehicle antenna defined in claim 1 wherein the fastener has a head bearing on the base plate and pressing same against the roof.

7. An antenna adapted to be mounted on a vehicle roof, the antenna comprising:

a base plate adapted to sit on the roof;

an inner cover fitted over the base plate and formed with an outwardly open threaded socket;

a decorative outer cover fitted over the inner cover around the socket, the socket being exposed through the outer cover; and an antenna rod having an end screwable into the socket and bearing downward on the outer cover to secure the outer cover on the inner cover and base plate.

8. The vehicle antenna defined in claim 7 wherein the inner cover is thick-walled and structural, and the outer cover is thin-walled.

9. The vehicle antenna defined in claim 7 wherein the outer cover has catch formations operatively engageable with the base plate.

10. The vehicle antenna defined in claim 9 wherein the base plate is formed with upstanding lugs having sets in which the catch formations are engageable.

* * * * *